US005141121A

United States Patent [19]

Brown et al.

[11] Patent Number: 5,141,121

[45] Date of Patent: Aug. 25, 1992

[54] HOT FILL PLASTIC CONTAINER WITH INVERTIBLE VACUUM COLLAPSE SURFACES IN THE HAND GRIPS

[75] Inventors: Randall S. Brown, Adrian; Theodore F. Eberle, Saline, both of Mich.

[73] Assignee: Hoover Universal, Inc., Plymouth, Mich.

[21] Appl. No.: 670,586

[22] Filed: Mar. 18, 1991

[51] Int. Cl.[5] ..... B65D 1/40; B65D 23/10

[52] U.S. Cl. ..... 215/100 A; 215/1 C; 220/675; 220/771

[58] Field of Search ..... 215/1 C, 1 R, 100 A; 220/94 A, 675, 609, 669; D9/408

[56] References Cited

U.S. PATENT DOCUMENTS

| | | | |
|---|---|---|---|
| 4,205,788 | 2/1989 | Akiho | 220/675 X |
| 4,381,061 | 4/1983 | Cerny et al. | 220/609 X |
| 4,804,097 | 2/1989 | Alberghini et al. | 220/675 X |
| 4,863,046 | 9/1989 | Collette et al. | 215/1 C |
| 4,877,141 | 10/1989 | Hayashi et al. | 220/675 X |
| 4,890,752 | 1/1990 | Ota et al. | 220/94 A X |
| 4,946,053 | 8/1990 | Conrad | 215/100 A X |
| 4,993,565 | 2/1991 | Ota et al. | 220/94 A X |

FOREIGN PATENT DOCUMENTS

| | | | |
|---|---|---|---|
| 90987 | 3/1968 | France | 215/1 C |
| 57-126310 | 8/1962 | Japan | 215/1 R |
| 571979 | 1/1976 | Switzerland | 215/1 C |
| 2218395 | 11/1989 | United Kingdom | 215/1 C |

*Primary Examiner*—Sue A. Weaver

*Attorney, Agent, or Firm*—Harness, Dickey & Pierce

[57] ABSTRACT

A hot-fill PET container which includes opposed hand grip sections in the sidewall enabling the container to be grasped between the thumb and fingers of one hand to facilitate handling of the container and pouring of liquid from the container. Each hand grip section includes an outwardly bulged surface having an outside edge and an integral hinge enabling opposite bulged surfaces to invert and collapse inwardly toward each other to accommodate internal forces tending to collapse the container sidewall inwardly due to filling of the container with liquid at an elevated temperature and subsequent cooling of the liquid.

5 Claims, 3 Drawing Sheets

HOT FILL PLASTIC CONTAINER WITH INVERTIBLE VACUUM COLLAPSE SURFACES IN THE HAND GRIPS

BACKGROUND AND SUMMARY OF THE INVENTION

This invention relates generally to hot-fill polyester containers and more particularly to a PET container of this type having hand grip indentations on diametrically opposite sides of the container provided with invertible vacuum collapse surfaces. These surfaces collapse inwardly to accommodate volumetric shrinkage of the container contents following filling with a hot liquid and cool down of the contents.

Thin walled PET containers of bottle shape are becoming increasingly recognized as desirable for containing liquids, such as processed fruit juices and the like, which must be pasteurized, and, as a result, are placed in the container when hot, namely, above about 180° F. Hot fill PET containers are well known. Examples are shown in U.S. Pat. Nos. 4,805,788 and 4,863,046. These containers are characterized by the fact that they are made of a heat set material such as PET with 28–32% crystalinity and they accommodate hot filling and partial evacuation without adverse affects on their appearance. Other hot fill containers are illustrated in earlier filed U.S. patent application Ser. Nos. 211,464; 452,638; and 492,073 owned by the assignee of this application and which have respectively issued as U.S. Pat. Nos. 5,005,716; 4,993,566; and 4,993,567.

These containers are formed by blow molding biaxially orientable polyethylene terephthalate (PET) resin. The result is containers which have a number of advantages such as being lightweight, having excellent mechanical strength, and physical properties, and being inexpensive in cost together with the ability to be produced in large numbers.

Because of the lightweight, thin-walled characteristic of such containers they can be made in large sizes and still be manually handled during storage and dispensing without undue manual effort.

In an earlier filed patent application assigned to the assignee of this application (Ser. No. 663,165, filed Mar. 1, 1991), an improved container of this type is disclosed in which an opposed pair of indentations are formed in the bottle sidewall so as to form hand grip sections. The hand grips enable the container to be grasped between the thumb and fingers of one hand to thereby enable one handed lifting and manipulation of the container. Furthermore, the hand grip indentations in the container are configured and structured so that they will collapse inwardly toward each other to accommodate internal forces tending to collapse the container sidewall inwardly due to filling of the container with liquid at an elevated temperature and subsequent cooling of the liquid. However, the degree of vacuum absorption lost when conventional vacuum absorption panels are replaced by the grip panels may be greater than desired.

The present invention constitutes an improvement on the container shown in the earlier patent application assigned to the assignee of this application in that in the present invention, the hand grip indentations are formed in the blow molded PET container with surface portions that are outwardly bulged in shape. Stated otherwise, the blow molded PET container is initially shaped so that the hand grip indentations are provided with outwardly bulging surfaces which are located outwardly of imaginary vertical planes extending through the container sidewalls.

When the container is filled with hot liquid which is subsequently allowed to cool, the resulting vacuum in the container causes the bulged surfaces to invert and move to positions inwardly of the above described imaginary vertical planes. This results in a reduction in the internal volume of the container which is adequate to compensate for the volumetric shrinkage of the liquid with which the container has been filled. In addition, in the inverted positions of the bulged surfaces, they contribute to the ability of the hand grip indentations to accommodate one-handed gripping and manipulation of the container.

Thus, the present invention utilizes the desirable characteristics of the prior art hot-fill containers and embodies in these containers the pinch grip indentations in a form in which the indentations accommodate the volumetric shrinkage of the container contents. This is accomplished with the initial bulged surfaces in the indentations so that accurate control can be maintained over the extent of volumetric shrinkage that is accommodated. The result is prevention of container sidewall buckling caused by an inability of the container structure to absorb the vacuum induced by volumetric shrinkage.

Further objects, features and advantages of the invention will become apparent from a consideration of the following description, the appended claims and the accompanying drawing.

DETAILED DESCRIPTION OF THE ILLUSTRATED EMBODIMENT

Figure 1:
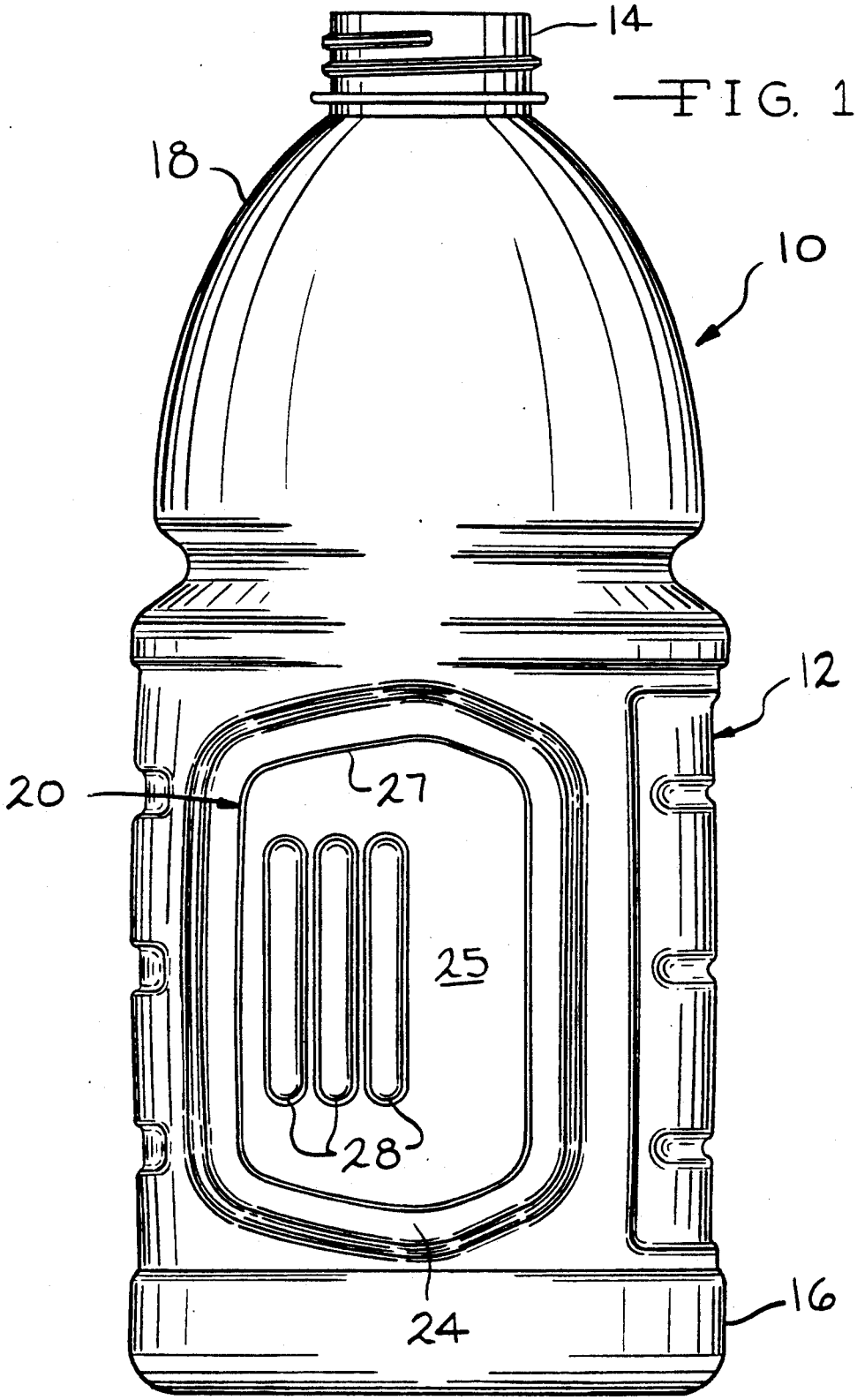
FIG. 1 is a side elevational view of the container of this invention, showing one of the hand grip portions in the container in elevation.

With reference to the drawing, the container of this invention, indicated generally at 10, is illustrated in FIG. 1 as having a main sidewall portion 12, an upper portion 14 defining a sealable closure, and a base portion 16. A generally dome shape portion 18 is located between the sidewall portion 12 and the closure 14.

The container 10 is a "hot-fill" container which is formed in a blow mold of a heat set material such as PET. The sidewall portion 12 includes an opposed pair of hand grip portions 20 enabling the sidewall portion 12 to be grasped between the thumb and fingers of one hand. As seen in FIGS. 2–5, the hand grips 20 form substantial indentations or deviations into the container 10. In other words, the hand grips 20 substantially deviate inward from the surface of the sidewall portion 12. Each hand grip 20 consists of a large irregularly shaped sidewall section 24 having an outwardly bulged surface portion 25 in the "as formed" shape of the container shown in FIGS. 2 and 3.

Figure 3:
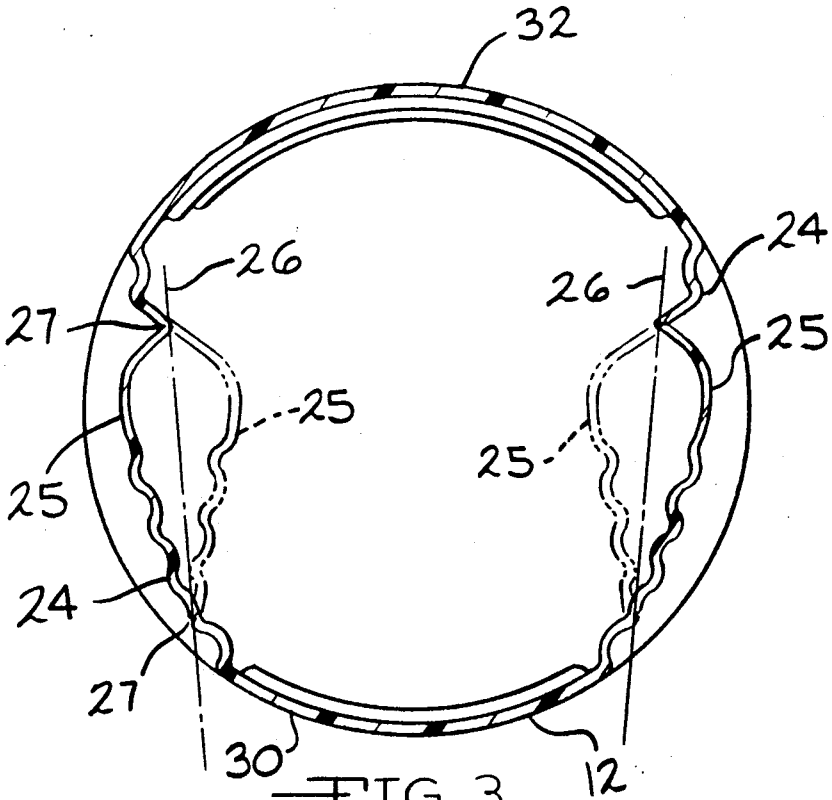
FIG. 3 is a transverse sectional view of the container shown in FIG. 2 as seen from substantially the line 3—3 in FIG. 2.
Figure 2:
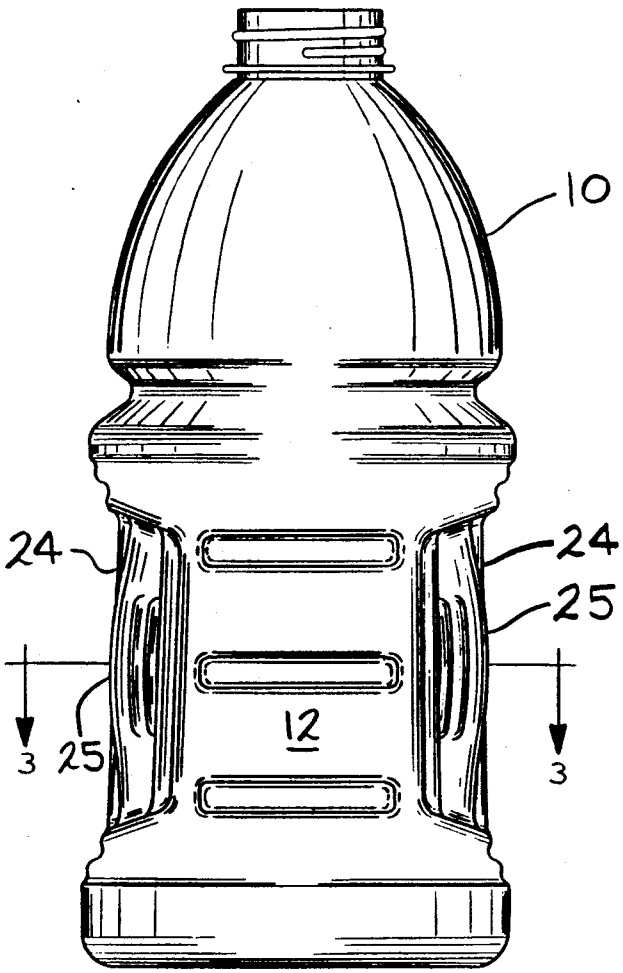
FIG. 2 is another side elevational view of the container of this invention showing the hand grip portions on diametrically opposite sides of the container and illustrating the container in its "as formed" shape prior to hot filling.
Figure 5:
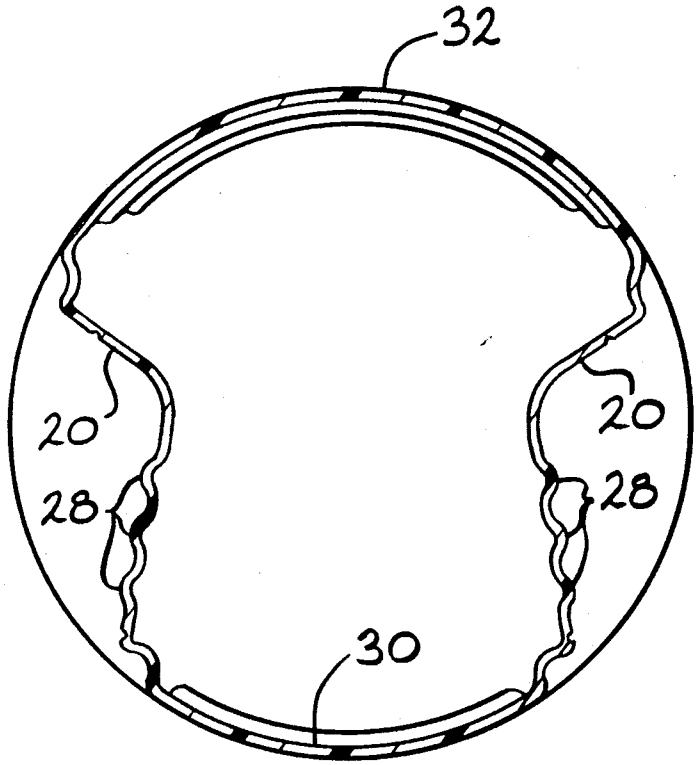
FIG. 5 is a transverse sectional view of the container shown in FIG. 4 as seen from substantially the line 5—5 in FIG. 4.
Figure 4:
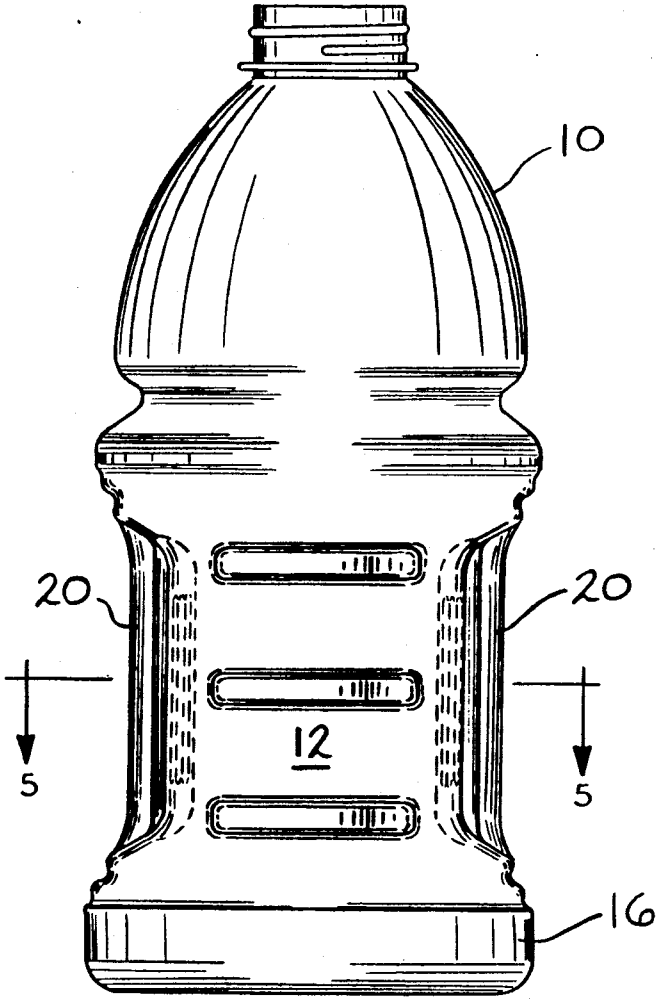
FIG. 4 is a side elevational view of the container of this invention similar to FIG. 2 illustrating the container in its "after hot filling and cooling" shape.

As shown in FIG. 3, the bulged surface 25 is positioned outwardly of an imaginary vertical plane 26 extending through the container sidewall. As will more clearly appear hereinafter, after the container 10 has been filled with a hot fluid and the fluid has been allowed to cool, the bulged surface 25 will invert to the position shown in broken lines in FIG. 3 and in solid lines in FIG. 5. In such position, the bulged surface 25 will have moved to a position in which it is located inwardly of the imaginary plane 26.

The volume in the container 10 represented by the areas between the solid and broken lines representing the bulged and then inverted surfaces 25 is equal to or slightly less than the volume of liquid lost in the container after cool down. Such volumetric shrinkage is a natural result of hot fill and subsequent cool down. The ability of the container 10 to accommodate this volumetric shrinkage by the simple expedient of providing the invertible bulged surface 25 in each hand grip 20 enables economical manufacture of commercially acceptable hot fill PET containers.

As best appears in FIGS. 1 and 3, each bulged surface 25 is bounded at its outer edge by a hinge strip 27 of curved cross-section so that it is concave in a direction axially inwardly of the container 10 for a purpose to appear presently.

Each of the hand grip sections 24 also includes a plurality of horizontally spaced upright anti-slip finger ribs 28 each of which forms an upright rib in the surface 24. As a result, each of the ribs 28 projects outwardly from the sidewall 12 of the container 10.

In the use of the container 10, the container is filled with a hot liquid and when the liquid cools, the bulged surfaces 25 will collapse inwardly to a substantially indented position, as shown in broken lines in FIG. 3, so as to accommodate the resulting shrinkage in volume of the fluid in the container as it cools. The hinge strip 27 enables the bulged surface 25 to readily flex or snap into the inverted position shown in broken lines in FIG. 3 and solid lines in FIG. 5. The result will be a container in which the fill line is at the desired level in the container after the liquid has cooled and the appearance of the container 10 is not significantly affected.

A user of the container 10, desiring to lift the container, either for transport purposes or for tipping to discharge the contents, will position his/her hands about the sidewall portion 12 so that the thumb is engaged with one of the indentations 20 and the forefingers are engaged with the other indentation 20. The hand grips 28 facilitate such engagement and ensure against inadvertent slipping. It is to be noted that there are diametrically opposite sidewall sections 30 and 32 in the sidewall portion that are positioned between the indentations 20. The user's hand can be positioned on the indentations 20 so that either of the sections 30 or 32 is straddled between the thumb and forefingers of the hand.

From the above description it is seen that this invention provides a hot-fill container in which handling of the container for either transport or pouring purposes is facilitated by the provision of hand grip sections 20 in diametrically opposite sections of the sidewall portion 12 of the container. These hand grip sections are also operable to form the necessary collapse panels in the hot-fill container 10 by virtue of the inclusion in these sections of the bulged surfaces 25 which will invert when the container is hot filled and then cools down.

We claim:

1. A thin walled plastic container formed by blow molding and adapted to be filled with liquid at a temperature elevated above room temperature, said container comprising an upper portion which includes a sealable closure, a lower base portion closing the bottom of the container and a sidewall portion of generally tubular shape formed integral with and extending between said upper and lower portions, said sidewall portion as formed by blow molding including a substantially diametrically opposed pair of hand grip portions being substantial deviations inward from said generally tubular shape of said sidewall portion and enabling the sidewall portion to be grasped between the thumb and fingers of one hand after the container has been filled with a liquid at an elevated temperature which has cooled to room temperature, said hand grip portions in the container as formed by blow molding and prior to filling with a liquid at an elevated temperature each including an irregularly shaped outwardly bulged surface having an outside edge, and hinge means connected to and extending between said outside edge and the adjacent sidewall portion to enable said bulged surface to invert and thereby accommodate internal forces tending to collapse said sidewall portion inwardly due to filling of the container with said liquid at an elevated temperature and subsequent cooling of the liquid.

2. The container according to claim 1 wherein said bulged surface is configured so that it is on opposite sides of a vertical plane in the outwardly bulged and inverted positions of said surface.

3. The container according to claim 2 wherein said hinge means comprises strips of plastic in said sidewall portion which are of curved shape in transverse cross-section and are formed integral with said bulged surface and said sidewall portion.

4. The container according to claim 3 wherein said strips are curved so as to be concave in a direction inwardly of said container in the bulged shape of said surface.

5. The container according to claim 4 wherein each of said hand grip portions has a plurality of generally upright anti-slip finger grips arranged side by side and positioned in said inverted surface, each of said grips being in the form of a rib projecting outwardly of the container sidewall.

* * * * *